United States Patent [19]

Egenhoefer

[11] Patent Number: 5,072,556

[45] Date of Patent: Dec. 17, 1991

[54] WALL ASSEMBLY CONSTRUCTION

[76] Inventor: George G. Egenhoefer, 3675 S. Loretta La., New Berlin, Wis. 53151

[21] Appl. No.: 453,679

[22] Filed: Dec. 20, 1989

[51] Int. Cl.[5] ..... E04B 2/44

[52] U.S. Cl. ..... 52/126.4; 52/379; 52/421; 52/442

[58] Field of Search ..... 52/396, 442, 439, 378, 52/379, 422, 425, 426, 427, 561, 378, 379, 380, 442, 126.3, 126.4, 421, 570

[56] References Cited

U.S. PATENT DOCUMENTS

| | | | |
|---|---|---|---|
| 1,226,214 | 5/1917 | Hopkins | 52/421 |
| 2,172,053 | 9/1939 | Robbins | 52/438 |
| 3,546,833 | 12/1970 | Perreton | 52/442 |
| 4,091,587 | 5/1978 | Depka | 52/421 |
| 4,114,337 | 9/1978 | Neuhardt | 52/442 |
| 4,228,628 | 10/1980 | Schlomann | 52/438 |
| 4,229,922 | 10/1980 | Clark, Jr. | 52/586 |
| 4,341,049 | 7/1982 | Hsi | 52/421 |
| 4,439,967 | 4/1984 | Dielenberg | 52/421 |
| 4,514,949 | 5/1985 | Crespo | 52/585 |
| 4,660,342 | 4/1987 | Salisbury | 52/379 |
| 4,698,947 | 10/1987 | McKay | 52/309.11 |
| 4,706,429 | 11/1987 | Young | 52/426 |

FOREIGN PATENT DOCUMENTS

| | | | |
|---|---|---|---|
| 2001452 | 1/1970 | Fed. Rep. of Germany | 52/426 |

*Primary Examiner*—John E. Murtagh

*Attorney, Agent, or Firm*—Michael, Best & Friedrich

[57] ABSTRACT

A mortarless wall assembly and method for constructing the wall assembly, the wall assembly comprising a plurality of building blocks, each of the building blocks including a pair of parallel sidewalls interconnected by a web, and a plurality of slots, the building blocks being specially adapted to receive reinforcing rods, pipe, conduit, and the like, and a plurality of restraining members specially adapted to be fitted into the building blocks to prevent relative horizontal movement of the building blocks with respect to one another and to ensure proper alignment of the building blocks in the wall assembly, the restraining members including portions adapted to be housed in the slots in the building blocks.

The building blocks, when assembled in the wall, being designed to receive poured concrete to form a solid, voidless wall, the wall including paths for concrete flow so that adjacent building blocks are joined to each other by concrete.

37 Claims, 4 Drawing Sheets

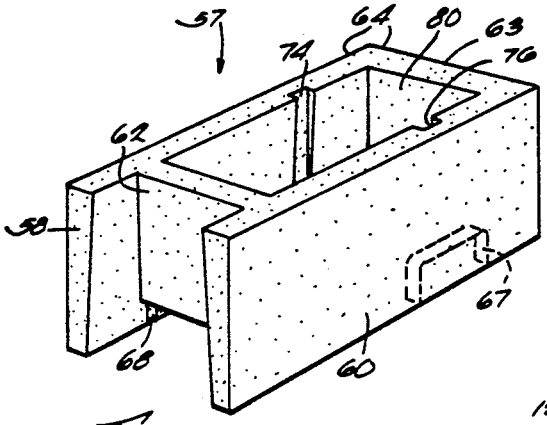
Fig. 4
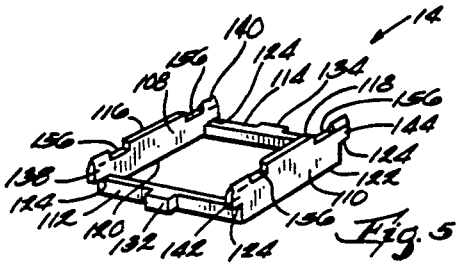
Fig. 5
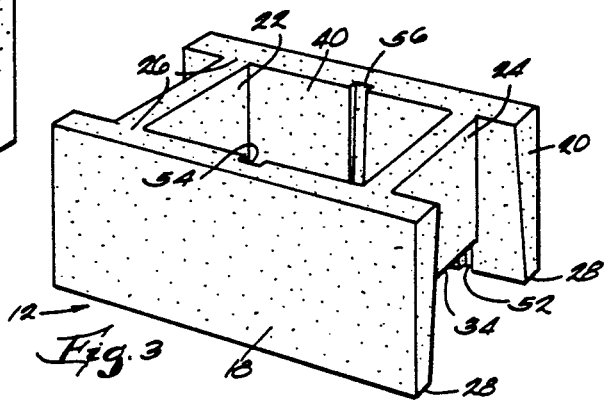
Fig. 3
Fig. 8
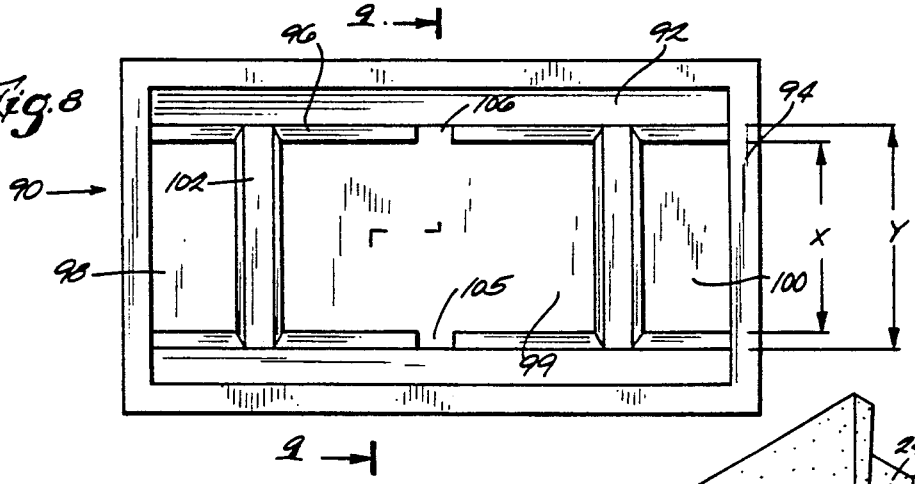
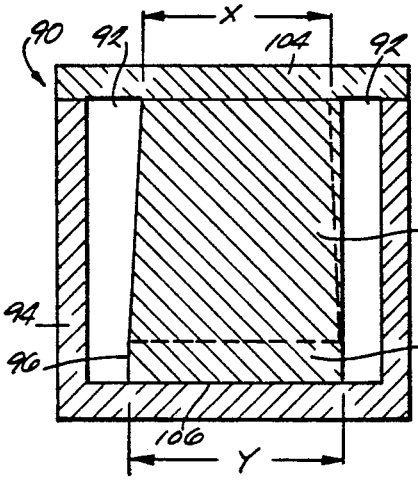
Fig. 9
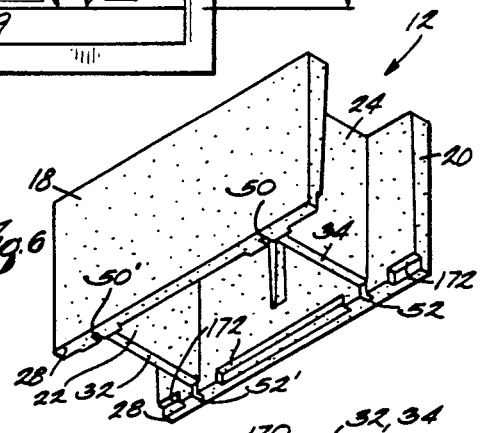
Fig. 6
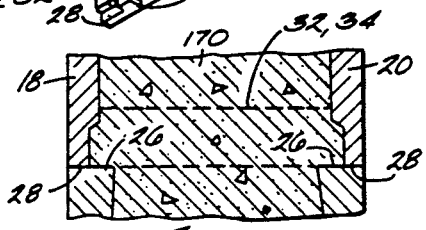
Fig. 7

Fig. 11
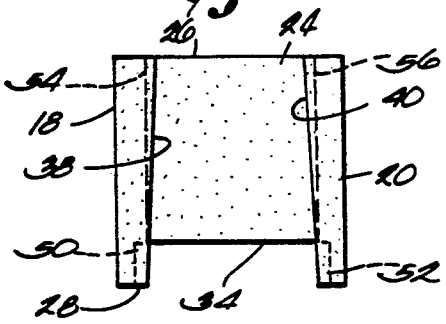
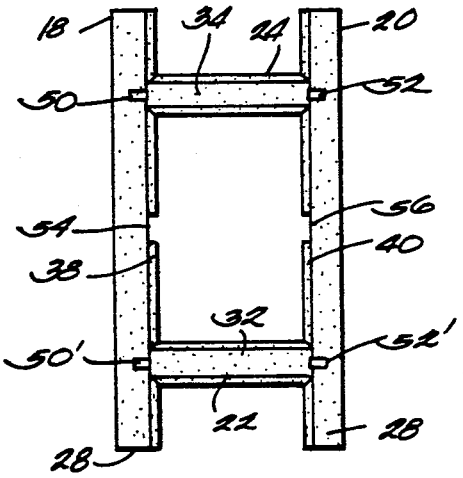
Fig. 10
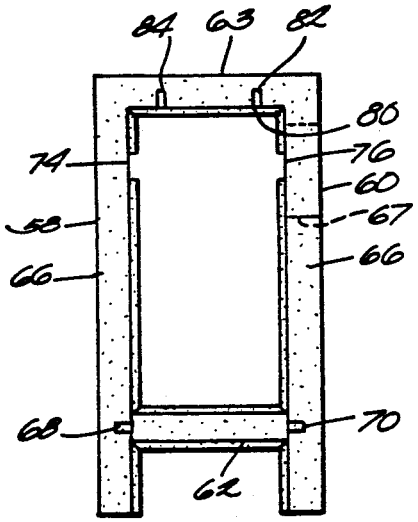
Fig. 12
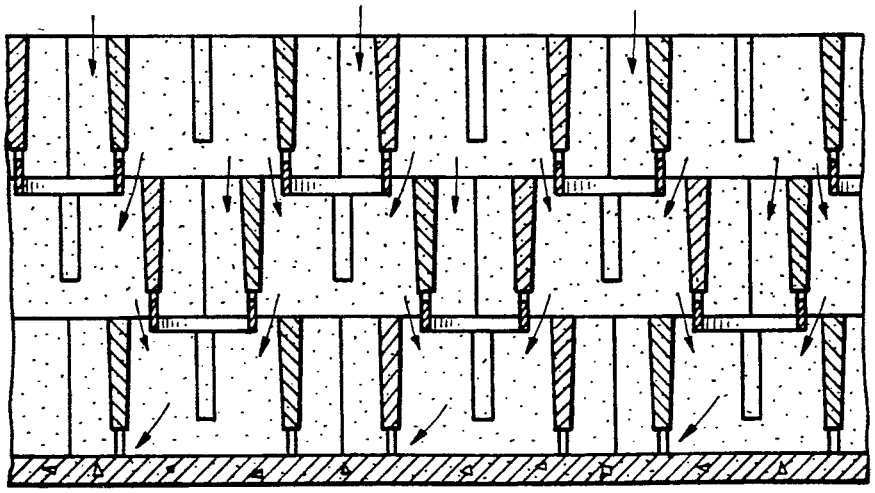
Fig. 13

WALL ASSEMBLY CONSTRUCTION

BACKGROUND OF THE INVENTION

1. Field of the Invention

The invention relates to building structures and methods for constructing such structures, and, more particularly, to wall assemblies and methods for constructing wall assemblies. The invention also relates to building blocks and to means for connecting neighboring building blocks together.

2. Reference to Prior Art

Wall structures or assemblies made of building blocks are generally well known. Typically, building blocks are arranged in vertically stacked horizontal rows to form the wall. Conventional building blocks are usually made of Portland cement and suitable aggregates combined with water and may also include other admixtures. Ordinary building blocks can be inexpensively made in a variety of sizes and configurations, making them a popular construction material.

The construction of walls or other structures made of building blocks has required skilled masons to insure that a wall structure made of concrete or masonry blocks is level, that the blocks in the structure are properly aligned, and that mortar or other such bonding materials are properly used. Use of such skilled labor results in high construction costs, and there exists a need for an assembly by which wall structures, and the like, may be quickly and easily erected without the use of mortar or other such bonding material, allowing a reduction in the expense of skilled labor.

Wall assemblies which are made of preformed building blocks and which include means other than mortar or other bonding materials for connecting the building blocks together are shown, for example, in U.S. Pat. No. 4,229,922, issued to Clark; U.S. Pat. No. 4,660,342, issued to Salisbury., and U.S. Pat. No. 4,228,628, issued to Schlomann.

It is sometimes desirable to construct a wall having a solid core of concrete. A wall assembly which includes concrete hollow core masonry blocks or blocks having spaces or cavities in them, and which has concrete filling these spaces to form a solid, voidless wall, is shown in U.S. Pat. No. 4,514,949, issued to Crespo, where concrete is poured into chambers in the building blocks to form columns. There exists a need for an assembly by which concrete filled wall structures may be quickly and easily erected without the use of skilled labor.

SUMMARY

The invention provides an improved wall structure assembly and method for constructing the wall assembly. The wall assembly is quickly, easily and inexpensively erected, and can be assembled without the use of mortar or other such bonding materials. The wall assembly can be of temporary or permanent nature and comprises a plurality of building blocks arranged in vertically stacked horizontal rows, and a plurality of restraining members adapted to interconnect the blocks thereby preventing relative horizontal movement between the blocks, the restraining members being adapted to connect at least a pair of building blocks of one row with at least one building block of an adjacent row. The wall assembly can be easily erected by simply laying a first row of blocks, fitting the blocks with restraining members, and laying a second row of blocks on the first row so that the restraining members also fit into those blocks in the second row. The wall assembly can also include reinforcing rods arranged vertically, horizontally and diagonally, and can further include tieing means for attaching exterior masonry to the wall assembly. The wall assembly can further include concrete which is poured into the interior of the wall to provide added strength. No special tools or skill is required in the construction of the wall assembly.

The building blocks and restraining members are specially adapted to cooperate with one another to ensure proper alignment of the blocks in the wall, and to prevent relative horizontal movement between the blocks in the wall. The building blocks and restraining members are specially designed to accommodate the reinforcing rods and tieing means, and to accept and support poured concrete in the interior of the wall. The building blocks and restraining members are also designed to accommodate pipes, conduit, or other such members running through or in the wall assembly.

Specifically, this invention provides a building block comprising first and second substantially parallel, spaced apart sidewalls, the sidewalls including opposed spaced apart inner surfaces, and each sidewall inner surface including upper and lower edges. Each of the building blocks includes first and second slots formed in one of the edges of at least one inner surface of either of the sidewalls. A third slot is formed in the other edge of the inner surface of at least one of the sidewalls. A first web, disposed between the sidewalls, rigidly interconnects the sidewalls.

The invention also provides a mold to be used to form the concrete blocks which make up the wall assembly.

The restraining member comprises a pair of block connecting members each including opposite ends, a portion of one of the opposite ends of one of the connecting members being adapted to be housed in one of the first and second slots in a building block in one row, and a portion of one of the opposite ends of the other connecting member being adapted to be housed in one of the first and second slots in another block in the same row. The restraining member also includes a transverse member extending between the connecting members and joining the connecting members, the transverse member including a projection adapted to be housed in the third slot in a block in a row adjacent the one row.

A principal feature of the invention is the provision of a wall structure which is made of building blocks and which is strong and which can be easily and quickly assembled by unskilled labor without the use of mortar, cement, or other like bonding materials for connecting adjacent building blocks.

Another principal feature of the invention is the provision of a method for constructing a wall which is made of building blocks and which is strong and which can be easily and quickly assembled or disassembled by unskilled labor.

Another principal feature of the invention is the provision of preformed building blocks adapted for use with means for securing neighboring blocks together without the use of mortar, or the like, the blocks being arranged in vertically stacked horizontal rows to form a wall structure.

Another principal feature of the invention is the provision of building blocks which are adapted for use in a wall constructed of vertically stacked horizontal rows of such blocks, and which include passageways to accept poured concrete, reinforcing rods, conduit, plumbing, and the like, and which cooperate with the means for securing neighboring blocks to accept such objects.

Another principal feature of the invention is the provision of a mold for forming building blocks having the aforementioned characteristics.

Another principal feature of the invention is the provision of restraining members which interconnect the building blocks in a wall structure and which provide means for aligning the blocks in vertically stacked horizontal rows to form a vertically and horizontally straight wall.

Still another principal feature of the invention is the provision of restraining members which are particularly adapted to prevent relative horizontal movement of one block relative to neighboring blocks in a wall structure, and more specifically, the provision of a restraining member having a particular configuration adapted to cooperate with blocks of the aforementioned kind to prevent relative horizontal movement of a block in one row relative to at least two neighboring blocks in an adjacent row of the wall.

Other features of the invention will become apparent to those skilled in the art upon review of the following detailed description, claims, and drawings.

BRIEF DESCRIPTION OF THE DRAWINGS

FIG. 3 is a perspective view of a building block used in construction of the wall assembly shown in FIGS. 1 and 2, and embodying features of the invention.

FIG. 4 is a perspective view of another form of building block used in the construction of the wall assembly shown in FIGS. 1 and 2.

FIG. 5 is a perspective view of a preferred form of restraining member used in construction of the wall assembly shown in FIGS. 1 and 2.

FIG. 6 is a perspective view of a building block similar to the building block shown in FIG. 3, and including notches in the bottom edges of the inner surfaces of each of the sidewalls.

FIG. 7 is a partial sectional view of the block shown in FIG. 6, and showing the block as part of a wall assembly filled with concrete.

FIG. 8 is a top plan view of a mold used for forming the building block shown in FIG. 3.

FIG. 9 is a sectional view taken along line 9—9 in FIG. 8.

FIG. 10 is a bottom view of the block shown in FIG. 3.

FIG. 11 is a side view of the block shown in FIG. 3.

FIG. 12 is a bottom view of the block shown in FIG. 4.

FIG. 13 is a side view, in section, of a portion of the wall assembly shown in FIG. 1, and showing the flow paths of concrete which is poured into the spaces between the sidewalls of the blocks to form a solid, voidless wall.

Figure 2:
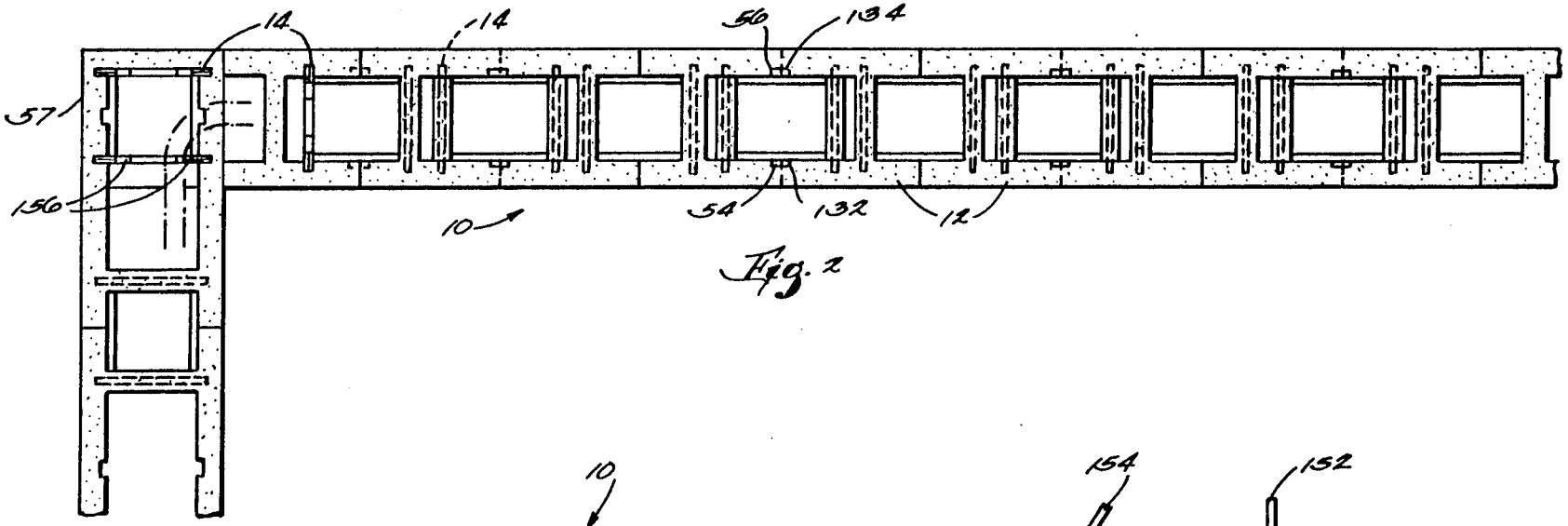
FIG. 2 is a top view of the wall assembly shown in FIG. 1.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Figure 1:
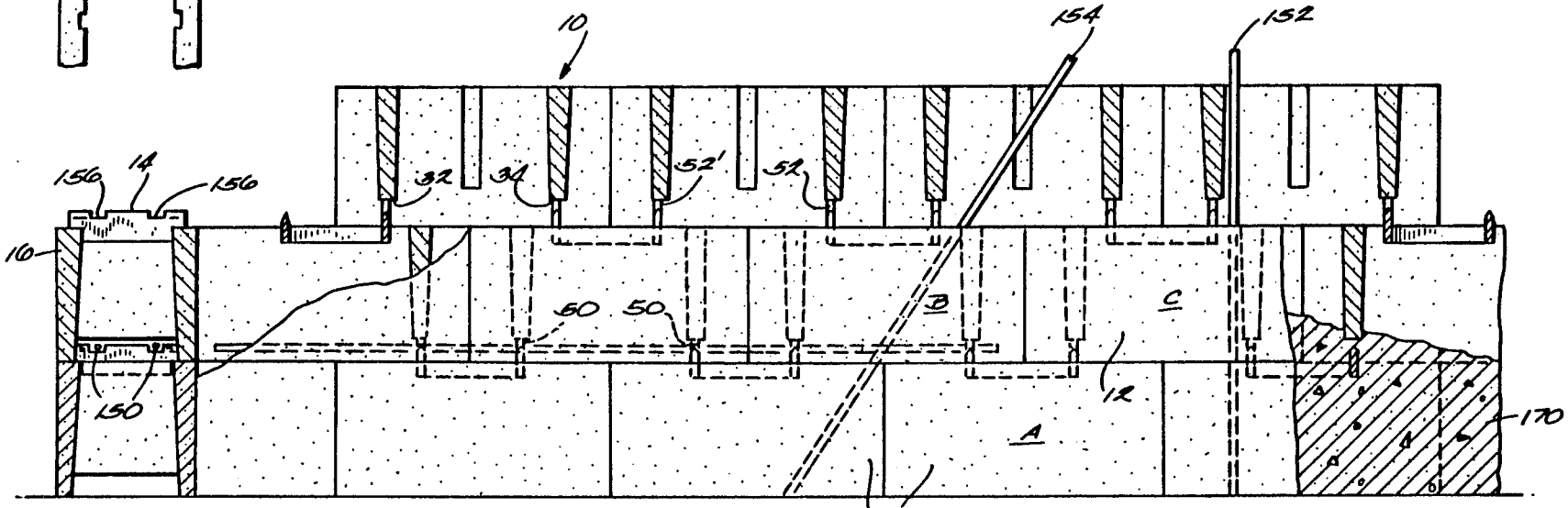
FIG. 1 is a side elevational view, partly in section, of a wall assembly embodying various features of the invention.

A wall assembly 10 embodying various of the features of the invention is illustrated in the drawings. As shown in FIG. 1, the wall assembly 10 includes a plurality of building blocks 12 arranged in vertically stacked horizontal row relation, and a plurality of restraining members 14 interconnecting the blocks. An illustrative building block 12 of a type which can be used in the wall assembly 10 is shown in FIG. 3. The blocks 12 are specially adapted to receive poured concrete, reinforcing rods, or other such materials. Also, the blocks 12 and the restraining members 14 are specially adapted to fit together, to cooperate to prevent horizontal movement of the blocks 12 relative to one another, and to insure alignment of the blocks 12 in the wall assembly 10, as will be seen from the following.

As shown in FIG. 3, the block 12 includes a pair of spaced apart, substantially parallel sidewalls 18 and 20, and a pair of spaced apart webs 22 and 24 disposed between the sidewalls 18 and 20 and rigidly interconnecting the sidewalls. Although the sidewalls 18 and 20 may be joined by only a single web, the use of a pair of webs is preferred. The webs 22 and 24 are spaced inwardly of the ends of the sidewalls 18 and 20. The block 12 is made of concrete, but in other embodiments the block 12 can be made of cinder block, plastic, wood or other suitable materials.

As shown in FIG. 3, the sidewalls 18 and 20 and the webs 22 and 24 each include top edges which are coplanar and which form the top 26 of the block 12. The sidewalls 18 and 20 and the webs 22 and 24 each also include bottom edges. The bottom edges of sidewalls 18 and 20 are coplanar and form the bottom 28 of the block 12. As shown best in FIG. 11, bottom edges 32 and 34 of webs 22 and 24, respectively, are preferably spaced above the bottom 28 of the block 12. The sidewalls 18 and 20 are tapered from top to bottom and include inner surfaces 38 and 40, respectively. The inner surfaces 38 and 40 include upper and lower edges which respectively lie in the top 26 and bottom 28 of the block 12.

While in the illustrated arrangement the bottom edges 32 and 34 of webs 22 and 24 are spaced above the bottom 28 of the block 12, in other arrangements the top edges of the webs 22 and 24 may be spaced below the top 26 of the block 12, and the bottom edges 32 and 34 of the webs 22 and 24 may be coplanar with the bottom 28 of the block 12.

As shown best in FIG. 10, each sidewall 18 and 20 includes a pair of substantially parallel spaced apart slots 50 and 50', and 52 and 52', respectively. The slots 50 and 50' are formed in the inner surface 38, and the slots 52 and 52' are formed in the inner surface 40. All four slots 50, 50', 52 and 52' extend upwardly from the bottom 28 of the block 12, and slots 50 and 50' oppose slots 52 and 52', respectively. In the illustrated arrangement, the slots 50, 50', 52 and 52' are positioned below the bottom edges 32 and 34 of the webs 22 and 24 and extend from the bottom 28 of the block 12 to the bottom edges 32 and 34.

While in the illustrated arrangement, the block 12 includes a pair of spaced apart slots 50 and 50' and a pair of spaced apart opposing slots 52 and 52', each of these slots extending upwardly from the bottom 28 of the block 12, in other arrangements, the block 12 can include as few as two spaced apart slots, each of the slots being located on either of the inner surfaces 38 and 40, and in still other arrangements, the slots 50, 50', 52 and 52' can extend downwardly from the top 26 of the block 12.

The sidewalls 18 and 20 also include a pair of keyways or slots 54 and 56. Preferably, the slots 54 and 56 oppose each other and are formed in the inner surfaces 38 and 40 of the block 12. As shown in FIG. 11, the slots 54 and 56 are formed in the inner surfaces 38 and 40, respectively, and extend downwardly from the top 26 of the block 12. Preferably, the slots 54 and 56 are located in the middle of the block 12.

While in the illustrated arrangement, the block 12 includes a pair of slots 54 and 56, each of these slots extending downwardly from the top 26 of the block 12, in other arrangements, the block could include only one of such slots, and in still other arrangements the slots 54 and 56 can extend upwardly from the bottom 28 of the block 12.

As shown best in FIG. 2, the wall assembly 10 can also include blocks having configurations different from that of block 12, such as the end or corner block 57. Referring specifically to FIG. 4, the corner block 57 includes a pair of sidewalls 58 and 60, and a web 62 arranged substantially as described relative to sidewalls 18 and 20 and web 22 of block 12. An end wall 63 interconnects the ends of sidewalls 58 and 60. The corner block 57 also includes a top 64 and a bottom 66 substantially as described relative to top 26 and bottom 28 of block 12. In the illustrated arrangement, the sidewall 60 of corner block 57 includes a portion 67 which can be knocked out by a hammer or other means to provide a hole for the passage of pipe, conduit, or other such members around the corner of the wall assembly 10, as shown in FIG. 2. The sidewall 58 and the end wall 63 of corner block 57 can also include a portion similar to portion 67. The opening 67 preferably extends upwardly from the bottom 66 of the block 57. The corner block 57 also includes a pair of slots 68 and 70 arranged substantially as described relative to slots 50 and 52 of block 12 and a pair of slots 74 and 76 arranged similarly to slots 54 and 56 of block 12.

As shown in FIG. 12, the end wall 63 of corner block 12 can include an inner surface 80 and a pair of slots 82 and 84 located on the inner surface 80, and extending upwardly from the bottom 66 of the corner block 57.

Shown in FIG. 8 is the top view of a mold 90 which is used to form the building block 12. The mold 90 has therein a cavity 92 which defines the block 12. The mold 90 includes an outer mold die 94 which defines the outer surfaces and the ends of the sidewalls 18 and 20 of block 12, and an inner mold die 96 which defines the remainder of the block 12. The inner mold die 96 includes three upstanding members 98, 99 and 100, and a bottom portion 102. The bottom portion 102 defines the bottom edges 32 and 34 of the webs 22 and 24 and a portion of the lower part of the inner surfaces 38 and 40 of block 12. The mold 90 also includes a top portion or cover 104 which defines the top 26 of the block 12. The upstanding members 98, 99 and 100 define the remainder of the inner surfaces 38 and 40 of the block 12, and also define the remainder of the webs 22 and 24. The member 99 includes a pair of projections 105 and 106 defining the slots 54 and 56 of the block 12. The inner mold die 96 includes top and bottom surfaces. The width of the top surface, shown by dimension X in FIG. 8, is shorter than the width of the bottom surface, shown by dimension Y, thereby forming tapered sidewalls.

FIG. 5 illustrates a restraining member 14 of the type which can be used in the wall assembly 10. The restraining member 14 can be made of a variety of materials such as plastic or metal, and can be formed by injection molding, casting, welding, forging, or other suitable methods.

In the illustrated arrangement, the restraining member 14 is in the form of a rectangularly shaped frame, including a pair of parallel block connecting members 108 and 110 forming opposite ends of the frame, and a pair of transverse members 112 and 114 extending between the block connecting members and joining the block connecting members. Although the connecting members 108 and 110 can be joined by a single transverse member, the use of a pair of transverse members 112 and 114 is preferred.

As best shown in FIG. 1, at least a portion of the restraining member 14 is intended to fit snugly into the space between the inner surfaces 38 and 40 of block 12 to prevent relative horizontal movement of the restraining member with respect to the block in the transverse direction. To accomplish this, the connecting members 108 and 110 each include top edges 116 and 118, and bottom edges 120 and 122, respectively. The top edges 116 and 118 are longer than the bottom edges 120 and 122, and shorter than the width of the block 12, and the bottom edges 120 and 122 have a length less than the distance between opposing inner surfaces 38 and 40 of the block 12. Each connecting member 108 and 110 also includes a pair of generally horizontal surfaces located between top edges 116 and 118 and bottom edges 120 and 122, the surfaces preferably being coplanar and referred to collectively as surfaces 124. The design of the connecting members 108 and 110 allows the portion of each of the connecting members which contains the respective bottom edges 120 and 122 to fit within the space between the inner surfaces 38 and 40. The surfaces 124 rest on the top 26 of the block 12 to prevent vertical movement of the restraining member 14 in the downward direction. The transverse members 112 and 114 are connected between the bottom edges 120 and 122 of the connecting members 108 and 110 so that the transverse members 112 and 114 also fit within the space between the inner surfaces 38 and 40.

The transverse members 112 and 114 of restraining member 14 include projections 132 and 134, respectively. Although the use of any number of projections is possible, a pair of projections 132 and 134 are preferred.

Referring to FIGS. 1 and 2, it will be seen that the projections 132 and 134 are adapted to be housed in the slots 54 and 56 so that relative horizontal movement of the restraining member 14 with respect to the block 12 in the longitudinal direction is prevented. While projections 132 and 134 are shown as being housed in slots 54 and 56, respectively, the restraining member 14 could easily be rotated 180 degrees so that projections 132 and 134 are housed in slots 56 and 54, respectively.

Each of the connecting members 108 and 110 also include a pair of opposite end portions 138 and 140, and 142 and 144, respectively.. The end portions 138, 140, 142 and 144 of the restraining member 14 preferably project upwardly beyond the top 26 of the block 12 when the restraining member 14 is fitted into the space between the inner surfaces 38 and 40 of the block 12. The end portions 138, 140, 142 and 144 of restraining member 14 are adapted to be housed in the slots 50, 50', 52, and 52' of the block 12. To assist in fitting the end portions 138, 140, 142 and 144 into the slots 50, 50', 52 and 52', the end portions can be at least partially wedged-shaped.

The restraining member 14 is designed to connect as many as three adjacent building blocks 12, denoted in FIG. 1 as blocks A, B and C. With restraining member 14 housed in the space between the inner surfaces 38 and 40 of block A, so that relative horizontal movement of the restraining member 14 with respect to block A is prevented, blocks B and C in the row above the row containing block A are positioned so that a pair of the end portions 138 and 140, or 142 and 144, fit into a pair of the slots 50 and 52, or 50' and 52' in each of the blocks B and C. Thus, the restraining member 14 thereby connects blocks A, B and C and prevents relative horizontal movement of the three blocks with respect to one another. The restraining member 14 also automatically aligns the blocks 12 in the wall.

The wall assembly 10 can include a plurality of reinforcing rods. As shown in FIG. 1 the wall assembly 10 can include horizontal reinforcing rods 150, vertical reinforcing rods 152, and diagonal reinforcing rods 154. Skilled iron workers are not required to install reinforcing rods 150, 152 and 154, as the rods are supported by the wall structure itself and need not include tie rods. The horizontal reinforcing rods 150 extend longitudinally through the wall assembly 10. To accommodate the horizontal rods 150, each of the connecting members 108 and 110 include therein one or more channels 156. The horizontal rods 150 are housed in the channels 156 of the restraining member 14. The webs 22 and 24 of the block 12 do not interfere with the horizontal rods 150 since, as previously set forth, the bottom edges 32 and 34 of the webs 22 and 24 are spaced above the bottom 28 of the block 12. Vertical reinforcing rods 152 and diagonal reinforcing rods 154 extend through the spaces between opposing inner surfaces 38 and 40 of the block 12. The spacing of the bottom edges 32 and 34 of webs 22 and 24 above the bottom 28 of the block 12 allows the passage of diagonal reinforcing rods 54 through adjacent building blocks 12.

Figure 14:
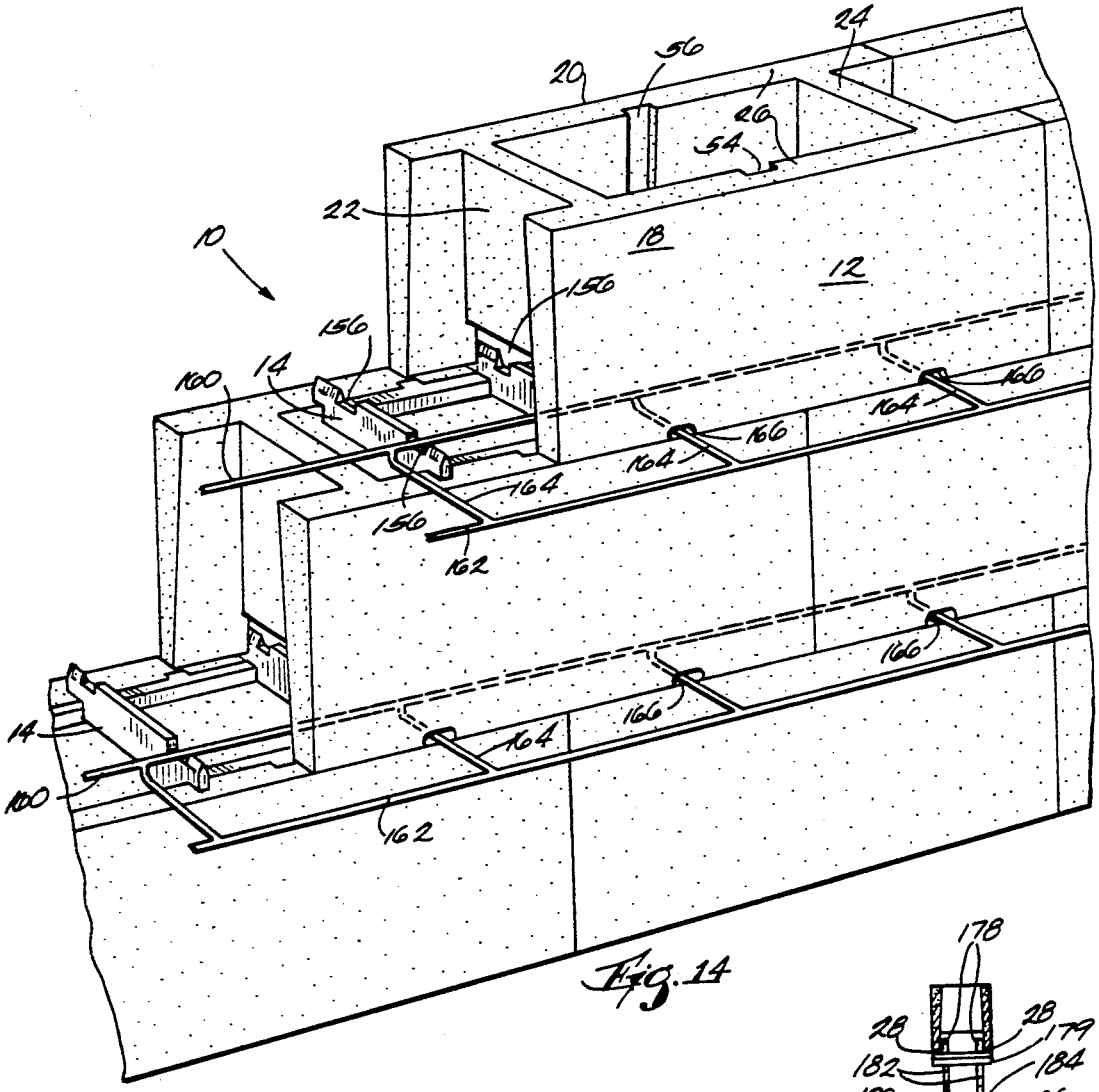
FIG. 14 is a perspective view of a wall assembly similar to FIG. 1, and showing means for tieing exterior masonry to the outside surface of the wall assembly.
Figure 16:
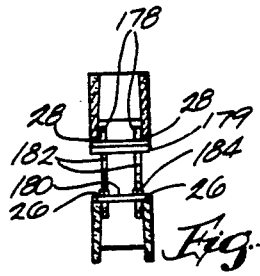
FIG. 16 is a sectional view taken along line 16—16, in FIG. 15.

In some applications it is desirable to add external masonry, such as decorative brick, to the wall assembly 10. As shown in FIG. 14, the wall assembly 10 can be provided with means for tieing external masonry to the wall assembly. While tieing means come in a variety of configurations, any one of which can be used in the wall assembly 10, in the illustrated arrangement, the tieing means include a pair of parallel elongated runners 160 and 162, and L-shaped spreader members 164 interconnecting the runners 160 and 162 to form a ladder-like structure. To accommodate the tieing means, one or both of the sidewalls 18 and 20 can include one or more transverse grooves 166 extending through the sidewall. The grooves are preferably formed in the bottom 28 of the block 12. The runner 160 extends through the channels 156 in the connecting members 108 and 110. The spreader members 164 extend through the grooves 166. The runner 162 is then embedded in the external masonry (not shown) to tie the masonry to the wall assembly 10.

In most applications it will be desirable to add concrete 170, or other such material into the voids or cavities in the wall assembly 10 formed by the spaces between the inner surfaces 38 and 40 of the block 12. The addition of concrete 170 provides a solid wall structure.

As shown in FIG. 6, the block 12 can be specially adapted for supporting the concrete 170. One or more notches 172 can be provided in the inner surfaces 38 and 40 of the sidewalls 18 and 20. The notches extend upwardly from the bottom 28 of the block 12. As shown in FIG. 7, when the blocks 12 are arranged in stacked rows, the notches 172 provide a means for supporting the concrete 170 within the wall assembly 10.

FIG. 13 shows a cross-sectional view of the wall assembly 10 shown in FIG. 1 and illustrates the flow paths taken by concrete poured into the interior of the wall assembly 10. The spaces between the inner surfaces 38 and 40 provide concrete flow paths down through the blocks 12 and the spacing of webs 22 and 24 inwardly of the ends of sidewalls 18 and 20 ensure that adjacent block 12 in the same horizontal row will be joined by concrete. The spacing of the bottom edges 32 and 34 of webs 22 and 24 above the bottom 28 of the block 12 provides a gap for concrete to flow laterally between blocks 12. This lateral flow ensures that adjacent blocks 12 in different rows are joined by concrete.

Figure 15:
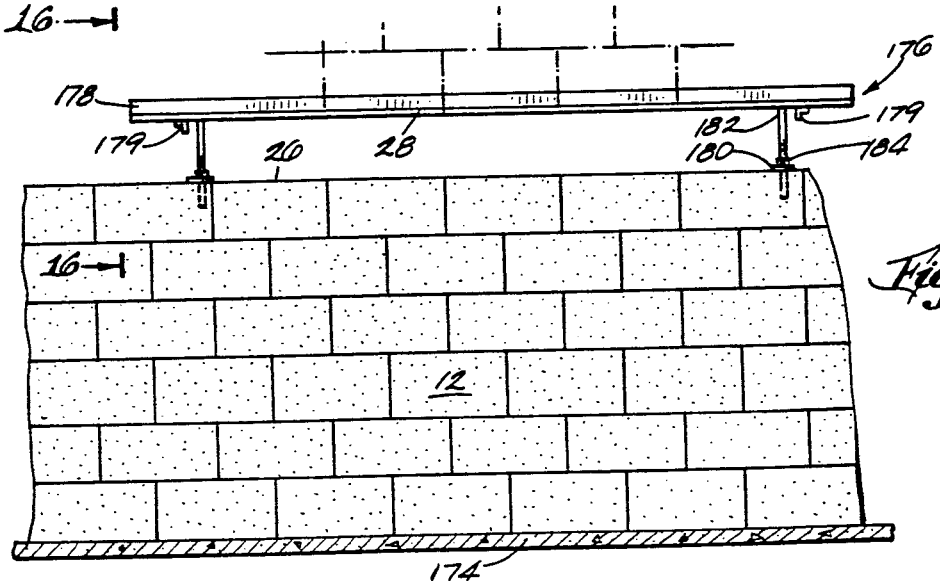
FIG. 15 is a side elevational view of a pair of walls separated by a wall starter fixture.

The wall assembly 10 is constructed as follows. The first step in constructing the wall assembly 10 requires the longitudinal aligning of a number of building blocks 12 to form a first row. The first row may be formed on a flat, level surface such as a floor slab or concrete footing 174, or on a started fixture 176, as shown in FIG. 15. The starter fixture 176 includes a pair of rails 178 on which the blocks 12 in the first row rest, one or more crossmembers 179 for connecting the rails 178, one or more support members 180 adapted to rest on the top 26 of one or more blocks 12 in a row below the first row, and a plurality of upright members 182 connecting the rails 178 and the support members 180. The upright members 182 are providing with adjustment means so that the wall assembly 10 may be leveled. Although any suitable adjustment means may be employed, in the illustrated arrangement, the adjustment means include an adjustment nut 184 which is threaded on to each of the upright members 182.

The next step in constructing the wall assembly 10 involves the fitting of restraining members 14 at least partially into the spaces between the inner surfaces 38 and 40 of each block 12 in the first row, as previously described, so that the projections 132 and 134 are housed in the slots 54 and 56, and the surfaces 124 abut against the top 26 of the blocks 12. Next, additional blocks 12 are stacked on the first row to form a second row. As shown in FIG. 1 and as previously mentioned, the end portions 138 and 140 of each of the restraining members 14 are to be housed in a pair of slots 50 and 52, or 50' and 52' in one of the blocks 12 of the second row, and end portions 142 and 144 are to be housed in a pair of slots in a second block in the second row. Either before or after stacking the second row of blocks on the first row of blocks, the reinforcing rods 150, 152 and 154 can be installed. The horizontal rods 150 are inserted into the channels 156 of the restraining members 14, and vertical and diagonal reinforcing rods 152 and 154 are inserted into the spaces between the inner surfaces 38 and 40 of the blocks 12.

If external masonry is to be attached to the wall assembly 10, the tieing means should be installed before the second and subsequent rows are stacked on top of lower rows. The tieing means are to be installed so that the runner 160 is received by the channels 156, and so that the spreader members 164 extend through the grooves 166.

The final step in constructing the wall assembly includes the addition of concrete 170 or other such material into the interior of the wall assembly 10 by pouring or other means. Vibrators which are generally well known may be inserted into the spaces between the inner surfaces 38 and 40 of the blocks 12 to ensure that the concrete 170 settles and does not leave voids or inclusions in the wall assembly. The grooves 166 can be used as weepholes to monitor the filling of the wall assembly 10 with concrete.

Various features of the invention are set forth in the following claims.

I claim:

1. A wall assembly comprising:

a plurality of building blocks arranged in vertically stacked horizontal rows, each of said building blocks including first and second spaced apart sidewalls, said sidewalls including opposed spaced apart inner surfaces, and each sidewall inner surface including an upper edge portion and a lower edge portion, a web disposed between said sidewalls and rigidly interconnecting said sidewalls, a first slot formed in one edge portion of an inner surface of one of the sidewalls, a second slot formed in said one edge portion of an inner surface of one of the sidewalls, and a third slot formed in the other edge portion of an inner surface of one of said sidewalls; and a plurality of restraining members adapted to interconnect said building blocks to thereby prevent relative horizontal movement between said building blocks, said restraining members each being adapted to connect together at least a pair of building blocks of one row and at least one building block of an adjacent row, each of each restraining members being located at least partially between said sidewalls, and each of said restraining members including a pair of block connecting members, said block connecting members each including opposite ends, a portion of one of said opposite ends of one of the block connecting members being housed in one of said first and second slots in a block in the one row, and a portion of one of the opposite ends of the other connecting member being housed in one of said first and second slots in another of said blocks in the one row, and each of said restraining members including a transverse member at least partially disposed between said connecting members and rigidly interconnecting said connecting members, said transverse member including a projection adapted to be housed in said third slot in at least one building block of the row adjacent the one row.

2. A wall assembly as set forth in claim 1, wherein each of the sidewalls of each block includes a top edge and a bottom edge and wherein said first web of each block has a bottom edge spaced above the bottom edges of said sidewalls.

3. A wall assembly as set forth in claim 2, wherein each of said connecting members of said restraining members includes a channel extending through said connecting member.

4. A wall assembly as set forth in claim 3, wherein said channel through each of said connecting members is longitudinally aligned with said channel in other connecting members.

5. A wall assembly as set forth in claim 1, wherein each of said connecting members includes a channel extending therethrough, and wherein said wall assembly further includes a plurality of reinforcing rods, said rods being horizontally disposed and extending through said channels.

6. A wall assembly as set forth in claim 4, wherein at least one of said top edge and bottom edge of one of said sidewalls includes a groove extending therethrough and transverse to said one of said sidewalls, and wherein said wall assembly further includes exterior masonry, and means extending through said groove and partially housed in said channels in said connecting members for tieing said exterior masonry to said blocks.

7. A wall assembly as set forth in claim 6, wherein said tieing means includes a pair of parallel elongated runners, one of said runners extending through said channels and the other of said runners located outside of said blocks and embedded in said masonry, and a spreader member extending through said groove and interconnecting said runners.

8. A wall assembly as set forth in claim 1 wherein said plurality of blocks each includes a second web parallel to said first web and disposed between said sidewalls and rigidly interconnecting said sidewalls.

9. A wall assembly as set forth in claim 8, wherein said second web includes a bottom edge, and wherein said bottom edge of said second web is spaced above the bottom edges of said sidewalls.

10. A wall assembly as set forth in claim 8, wherein said second web interconnects the ends of said sidewalls.

11. A wall assembly as set forth in claim 10, wherein one of said sidewalls has therein an opening extending from said bottom edge of said sidewall toward said top edge of said sidewall.

12. A wall assembly as set forth in claim 10, wherein said second web includes an inner surface, said inner surface including a fourth slot extending from one edge of said second web toward the other edge of said second web.

13. A wall assembly as set forth in claim 1, and further including a plurality of vertically disposed reinforcing rods and a plurality of reinforcing rods disposed at acute angles to said vertically disposed rods, said rods extending through said spaces between said sidewalls.

14. A wall assembly as set forth in claim 1, and further including a wall starter fixture for separating rows of said blocks including a pair of rails adapted to house said bottom edges of said sidewalls in an upper row, a pair of support members adapted to rest o said top edges of said sidewalls in a lower row, and a plurality of upright members adjustably connecting said rails to said support members.

15. A wall assembly as set forth in claim 1, wherein said sidewalls are wider at the top edge than at the bottom edge, and wherein said sidewalls include therein a notch in each of said lower edge portions of said inner surfaces.

16. A wall assembly as set forth in claim 1, wherein each of said inner surfaces of each of said sidewalls includes a pair of spaced apart substantially parallel slots in one edge portion of said inner surfaces, said pair of slots extending from one edge of said sidewalls toward the other edge of said sidewalls, and wherein said pair of slots in one inner surface oppose said pair of slots in the other inner surface of said blocks.

17. A wall assembly as set forth in claim 16, wherein each of said pair of slots extend from said bottom edge toward said top edge of said sidewalls, and wherein said third slot extends from said top edge of said one of said sidewalls toward said bottom edge of said one of said sidewalls.

18. A wall assembly as set forth in claim 16, wherein said opposite ends of one connecting member are adapted to be housed in a pair of opposing slots in one block, and opposite ends of the other connecting member are adapted to be housed in a pair of opposing slots in another block in the same row as said one block.

19. A wall assembly as set forth in claim 1, wherein said restraining members each comprise a generally rectangular frame, said pair of block connecting members forming opposite ends of said frame and being generally mutually parallel, and a pair of transverse members joining said block connecting members.

20. A restraining member for use in the construction of walls and the like, the wall including a plurality of building blocks arranged in vertically stacked horizontal rows, each of the blocks including first and second spaced apart sidewalls, each sidewall including a top edge, a bottom edge, first and second slots formed in one of the top and bottom edges, and a third slot formed in the other of the top and bottom edges, said restraining member being adapted to connect a pair of building blocks of one row with a building block of an adjacent row, said restraining member comprising:

a pair of elongated block connecting members each including a top edge portion, a bottom edge portion, one of the said top and bottom edge portions having a length greater than the distance between the sidewalls of each of the blocks, and the other of said top and bottom edge portions having a length less than the length of said one edge portion and being adapted to fit between the sidewalls of the block in the adjacent row, a support surface between said top and bottom edge portions, said surface being adapted to engage one of the top and bottom edges of the sidewalls of the block in the adjacent row, and opposite ends, a portion of one of said opposite ends of one of said connecting members being defined between said support surface of said one connecting member and said one edge portion of said one connecting member and being adapted to be housed in one of the first and second slots in one of the pair of blocks in the one row and a portion of one of said opposite ends of said other connecting member being defined between said support surface of said other connecting member and said one edge portion of said other connecting member and being adapted to be housed in one of the first and second slots in the other of the pair of blocks in the one row; and an elongated transverse member extending between said connecting members and joining said connecting members, said transverse member including a projection adapted to be housed in the third slot in the block in the row adjacent the one row.

21. A restraining member as set forth in claim 20, wherein said restraining member comprises a generally rectangular frame, and includes a pair of transverse members, said pair of block connecting members forming opposite ends of said frame and being generally mutually parallel, and said pair of transverse members joining said block connecting members.

22. A restraining member as set forth in claim 20, wherein each of said opposite ends of one of said connecting members is adapted to be housed in one of the first slots in one of the pair of blocks in the one row, and each of said opposite ends of the other of said connecting members is adapted to be housed in one of the second slots in the other of the pair of blocks in the one row.

23. A restraining member as set forth in claim 22, wherein each of said opposite ends of each of said connecting members is wedge shaped.

24. A restraining member as set forth in claim 22, wherein the first and second slots in each sidewall are formed in the bottom edge thereof, and the third slot in each sidewall is formed in the top edge thereof, wherein said top edge portion of each of said connecting members is longer than said bottom edge portion thereof, wherein each of said connecting members includes a pair of generally horizontal surfaces between said top and bottom edge portions thereof, and wherein one of said opposite ends of each one of said connecting members is defined between said top edge of said one connecting member and one of said horizontal surfaces of said one connecting member, and the other of said opposite ends of said one connecting members is defined between said top edge of said one connecting member and the other of said horizontal surfaces of said one connecting member.

25. A restraining member as set forth in claim 20, wherein said top edge portion of each of said connecting members has a length greater than the distance between the sidewalls of each of the blocks.

26. A restraining member as set forth in claim 20, wherein each of said connecting members is a generally planar upright member.

27. A restraining member as set forth in claim 20, wherein each of the support surfaces is adapted to engage the top edges of the sidewalls of the block in the row adjacent the one row to support the restraining member thereon.

28. A wall assembly comprising:

a plurality of building blocks arranged in vertically stacked horizontal rows, each of said building blocks including a pair of spaced apart sidewalls, each of said sidewalls including a top edge, a bottom edge, an inner surface, a first slot in one of said top and bottom edge portions and extending along said inner surface, and a web extending between said spaced apart sidewalls and interconnecting said sidewalls; and a plurality of restraining apparatus, each of said restraining apparatus including an elongated first block connecting member having top and bottom edge portions, one of said top and bottom edge portions having a length greater than the distance between said sidewalls of said blocks, and the other of said top and bottom edge portions having a length less than the length of said one edge portion and being adapted to fit between the sidewalls of a block in one row, a pair of support surfaces between said top and bottom edge portions, each of said support surfaces being engageable with one of said top and bottom edges of the sidewalls of the block in the one row, and opposite end portions, one of said opposite end portions being defined between said one edge portion and one of said support surfaces and being receiveable in said first slot in one of the sidewalls of a block in a row adjacent the one row, and the other of said opposite end portions being defined between said one edge portion and the other of said support surfaces and being receiveable in said first slot in the other of the sidewalls of the block in the row adjacent the one row, whereby each of said restraining apparatus restricts horizontal movement of the block in the one row relative to the block in the row adjacent the one row.

29. A wall assembly as set forth in claim 28, wherein each of said sidewalls includes a second slot in said one of said top and bottom edge portions, and wherein each of said restraining apparatus includes a second elongated block connecting member spaced from said first block connecting including top and bottom edge portion, one of said top and bottom edge portions of said second block connecting member being adapted to fit between the sidewalls of the block in the one row, a pair of support surfaces between said top and bottom edge portions of said second block connecting member, each of said support surfaces of said second block connecting member being engageable with one of said top and bottom edges of the sidewalls of the block in the one row, and opposite end portions, one of said opposite end portions of the second block connecting member being defined between said one edge portion of said second block connecting member and one of said support surfaces of said second block connecting member and being receiveable in said second slot in one of the sidewalls of another block in a row adjacent the one row, and the other of said opposite end portions of the second block connecting member being defined between said one edge portion of said second block connecting member and the other of said support surfaces of said second block connecting member and being receiveable in said second slot in the other of the sidewalls of the other block in the row adjacent the one row.

30. A wall assembly as set forth in claim 29, wherein said bottom edge portions of said block connecting members fits between the sidewalls of the block in the one row, and wherein each of said support surfaces of each of said block connecting members is generally horizontal and is engageable with the top edge of the sidewalls of the block in the one row to support said block connecting members thereon.

31. A wall assembly as set forth in claim 29, wherein one of said sidewalls of each of said building blocks includes a third slot in the other of said top and bottom edges of said one sidewall, and wherein said restraining apparatus includes an elongated transverse member interconnecting said first and second blocking connecting members and including a projection receivable in the third slot in the block in the one row so that said restraining apparatus prevents relative horizontal movement of the block in the one row and the two blocks in the row adjacent the one row.

32. A restraining apparatus for use in the construction of a wall including a plurality of building blocks arranged in vertically stacked rows, each building block including a pair of laterally spaced apart sidewalls, each sidewall having opposite top and bottom edges, and a pair of spaced apart first and second slots in one of the top and bottom edges, said restraining apparatus comprising:

an elongated first block connecting member adapted to prevent lateral movement of a first block in one row relative to a second block in a row adjacent the one row, said first block connecting member including an top edge portion;

a bottom edge portion;

one of the top and bottom edge portions having a length greater than the distance between the sidewalls of the blocks, and the other of said top and bottom edge portions having a length less than the length of said one edge portion and being adapted to fit between the sidewalls of the second block;

a pair of support surfaces between said top and bottom edge portions, each of said support surfaces being adapted to engage one of the top and bottom edges of the sidewalls of the second block; and opposite end portions, one of said opposite end portions being defined between said one edge portion and one of said opposite end portions and being adapted to fit in the first slot in one of the sidewalls of the first block, and the other of said opposite end portions being defined between said one edge portion and the other of said support surfaces and being adapted to fit in the first slot in the other of the sidewalls of the first block.

33. A restraining apparatus as set forth in claim 32, wherein said bottom edge portion of said first block connecting member has a length less than the length of said top edge portion and said first block connecting member.

34. A restraining apparatus as set forth in claim 33, wherein each block includes a third slot in the other of the top and bottom edges, wherein the restraining apparatus includes a second block connecting member including a top edge portion having a length greater than the distance between the sidewalls of the blocks, a bottom edge portion adapted to fit between the sidewalls of the second block, and opposite end portion, each of said opposite end portions of the second block connecting member being partially defined by said top edge portion of said second block connecting member, one of said opposite end portions of said second block connecting member being adapted to fit in one of the second slots in the sidewalls of a third block in the one row, and the other of said opposite end portions of said second block connecting member being adapted to fit in the other second slot in the sidewalls of the third block, and wherein the restraining apparatus also includes a transverse member interconnecting said first and second block connecting members and including a projection adapted to fit in the third slot in the second block so that horizontal movement of the first, second and third blocks relative to one another is prevented.

35. A restraining apparatus as set forth in claim 32, wherein said first block connecting member is a generally planar upright member.

36. A restraining apparatus as set forth in claim 32, wherein each of said opposite ends is wedge shaped.

37. A restraining member for use in the construction of a wall including a plurality of building blocks arranged in vertically stacked horizontal rows, each of the blocks including spaced apart sidewalls, each sidewall including top and bottom edges, an inner surface, first and second spaced apart slots formed in the bottom edge and extending along the inner surface, and a third slot formed in the top edge and extending along the inner surface, said restraining member being adapted to interconnect first and second building blocks of one row with a third building block in a row adjacent the one row to prevent horizontal movement of the first, second and third blocks relative to one another, said restraining member comprising:

a pair of elongated, generally parallel and horizontally spaced apart first and second block connecting members, each of said first and second block connecting members being generally planar and upright and including a top edge portion having a length greater than the distance between the sidewalls of the blocks, a bottom edge portion which is shorter than said upper edge portion and which is adapted to fit between the sidewalls of the third block, a pair of generally horizontal surfaces between said top and bottom edge portions, each of said horizontal surfaces being adapted to engage the top edge of one of the sidewalls of the third block to support the connecting members on the third block, and opposite end portions, each of said end portions being defined between the top edge portion and one of said horizontal surfaces and being at least partially wedged shaped, said opposite end portions of said first block connecting member being adapted to fit into the first slots in the sidewalls of the first block, and said opposite end portions of said second block connecting member being adapted to fit into the second slots in the sidewalls of the second block; and a pair of elongated transverse members connected between the bottom edge portions of said first and second block connecting members to form a generally rectangular frame structure, each of said transverse members including a projection adapted to be received in one of the third slots in the sidewalls of the third block.

* * * * *